US005326662A

United States Patent [19]

Jugle, deceased et al.

[11] Patent Number: 5,326,662

[45] Date of Patent: Jul. 5, 1994

[54] PASSIVATED TONER COMPOSITIONS AND PROCESSES THEREOF

[75] Inventors: Don B. Jugle, deceased, late of Rochester, N.Y., by Kip L. Jugle, executor; Jacques C. Bertrand, Ontario; Roger N. Ciccarelli, Rochester, both of N.Y.

[73] Assignee: Xerox Corporation, Stamford, Conn.

[21] Appl. No.: 907,097

[22] Filed: Jul. 1, 1992

[51] Int. Cl.[5] ..... G03G 9/097

[52] U.S. Cl. ..... 430/110; 430/138

[58] Field of Search ..... 430/106, 110, 109, 138

[56] References Cited

U.S. PATENT DOCUMENTS

| | | | |
|---|---|---|---|
| 4,254,203 | 3/1981 | Dka et al. | 430/120 |
| 4,291,112 | 9/1981 | Lu | 430/110 |
| 4,464,453 | 8/1984 | Cooper et al. | 430/126 |
| 4,937,167 | 6/1990 | Maffat et al. | 430/137 |
| 5,023,161 | 6/1991 | Kitabatake et al. | 430/137 |

*Primary Examiner*—John Goodrow

*Attorney, Agent, or Firm*—E. O. Palazzo

[57] ABSTRACT

A toner composition comprised of resin particles, passivated pigment particles coated with a polymeric coating, and a passivated tribofiller component coated with a polymeric coating, and wherein the tribofiller component possesses the same, or substantially the same index of refraction as the resin particles in the visible region of the spectrum.

21 Claims, No Drawings

PASSIVATED TONER COMPOSITIONS AND PROCESSES THEREOF

BACKGROUND OF THE INVENTION

This invention is generally directed to toner and developer compositions, and more specifically, the present invention is directed to developer and toner compositions containing a tribofiller which imparts or assists in imparting charge to the toner resin particles and enable toners to be formulated with dissimilar passivated pigments irrespective in embodiments of the pigment volume selected. There are provided in accordance with the present invention toner compositions comprised of resin particles, passivated pigment particles, and tribofillers to enable toners with relatively constant triboelectric charging characteristics irrespective of the passivated pigment loading. In one embodiment, the present invention is directed to toners with known pigments, like cyan, magenta, yellow, red, blue, green, black, mixtures thereof, and the like and certain tribofillers which are added to the toner. The toner pigments selected can be passivated with a polymeric coating. The tribofillers can be comprised, for example, of passivated finely compounded materials selected on the primary basis that they are transparent in the visible region of the spectrum and that they have nearly the same, or identical index of refraction as that of the toner resin. The tribofillers can also be passivated with the polymeric coating selected to passivate the toner pigment. A constant triboelectric series of materials can be designed for several different pigments which utilize different concentrations by assuring a constant volume fraction of pigment and tribofiller in the toners thereof. The toner and developer compositions of the present invention can be selected for electrophotographic, especially xerographic, imaging and printing processes, including color processes.

Toners with passivated pigments include those comprised of known toner resins, colored pigments, such as red, blue, green, cyan, magneta, yellow, or mixtures thereof, and wherein the pigment is passivated, or rendered substantially inactive with respect to the adverse electrical effects that are imparted to the toner. Passivated pigments and processes thereof are disclosed, for example, in copending patent applications U.S. Ser. No. 705,995, U.S. Pat. No. 5,208,129 and U.S. Pat. No. 5,212,035 the disclosures of which are totally incorporated herein by reference.

In a patentability search report there was recited as background interest U.S. Pat. Nos. 4,937,167; 5,023,161; 4,524,203 and 4,291,112.

SUMMARY OF THE INVENTION

It is an object of the present invention to provide toner and developer compositions with many of the advantages illustrated herein.

In another object of the present invention there are provided positively charged toner compositions useful for the development of electrostatic latent images including color images.

In another object of the present invention there are provided negatively charged toner compositions useful for the development of electrostatic latent images including color images.

In yet another object of the present invention there are provided a number of toner compositions with similar triboelectric charging characteristics irrespective of the passivated pigment component selected by incorporating on a constant volume loading basis a passivated tribofiller with an index of refraction which closely is equal to the resin in the visible spectrum.

In yet a further object of the present invention there are provided toners with constant acceptable triboelectric charging characteristics of from about 10 to about 40 microcoulombs per gram.

Another object of the present invention resides in colored toners with passivated pigments and wherein the toner tribocharge is substantially constant, for example about 25 microcoulombs per gram.

Furthermore, in yet another object of the present invention there are provided colored toner and developer compositions with passivated pigments, a passivated optically inactive material, or tribofiller, which compositions are useful in a variety of electrostatic imaging and printing processes, including color xerography.

Another object of the present invention resides in the formation of toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is those exceeding 70 copies per minute.

These and other objects of the present invention can be accomplished in embodiments thereof by providing toner compositions comprised of resin particles, pigment particles and tribofillers. More specifically, the present invention in embodiments is directed to toner compositions comprised of resin, passivated pigments encapsulated within a polymer, and wherein there is added to the toner passivated tribofillers with a polymer coating.

In embodiments, the present invention is directed to a toner composition comprised of resin particles, passivated pigment particles coated with a polymeric coating, and a passivated tribofiller component coated with a polymeric coating, and wherein the tribofiller component possesses the same, or substantially the same index of refraction as the resin particles in the visible region of the spectrum, and processes thereof.

Examples of tribofillers present in various effective amounts, such as for example from about 0.2 to about 15 percent of the toner formulation on a volume basis, include orthoclase ($KAlSi_3O_8$ based glass), $SrNO_3$, Albite ($NaAlSi_3O_8$ based glass), fumed silica ($SiO_2$), $SiCl_4$, LiF, NaF, $CaF_2$, MgO, $SiO_2$, $CaClO_3$, polymers, like polyesters, styrene acrylates, styrene methacrylates, styrene butadienes, methyl methacrylate, or mixtures thereof. The tribofillers generally have an index of refraction of from about 1.4 to about 1.6 which is equal to the refraction index of the toner resin over the visible spectrum. More specifically, the volume 0.2 to about 20 loading of pigment and tribofiller with the approximately same particle size, for example the particles of pigment and tribofillers are in the range of 0.05 to 0.75 micron average volume diameter, can be constant, about 2 to 20 percent of the total toner formulation for a series of colored pigments to be used to prepare a series of colored toners for operation in one machine configuration, like the Xerox Corporation 1075 wherein a constant, for example within plus or minus two tribo units, is selected.

The toner pigments are passivated by encapsulation with a polymeric coating. The pigment to polymer ratio to ensure complete coverage can be, for example, 1/1 for pigments with an average particle diameter of 0.1 to 0.4 micron. The tribofillers are also similarly passivated by encapsulation within a polymeric coating. The tribofiller to polymer coating ratio to ensure complete coverage can, for example, be 1/1 for tribofiller particles with an average particle diameter of 0.1 to 0.4 micron. The tribofillers are generally comprised of fine particles with an average volume diameter of from about 0.05 to about 2 microns.

In another embodiment of the present invention, there are provided, subsequent to known micronization and classification, toner particles with an average diameter of from about 5 to about 20 microns comprised of resin, passivated pigment particles, and passivated tribofillers.

The toner compositions of the present invention can be prepared by a number of known methods such as admixing and heating resin particles, such as styrene butadiene copolymers, passivated colored pigment particles, and passivated tribofillers in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 5 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Illustrative examples of suitable resins selected for the toner and developer compositions of the present invention include polyamides, polyolefins, styrene acrylates, styrene methacrylate, styrene butadienes, crosslinked styrene polymers, epoxies, polyurethanes, vinyl polymers, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like. Specific examples of toner polymers include styrene butadiene copolymers with a styrene content of from about 70 to about 95 weight percent, reference the U.S. patents mentioned herein, the disclosures of which have been totally incorporated herein by reference. In addition, crosslinked resins including polymers, copolymers, and homopolymers of the aforementioned styrene polymers may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES ®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 1,000 to about 7,000 such as polyethylene, polypropylene, and paraffin waxes can be included in, or on the toner compositions as fuser roll release agents.

The resin particles are present in a sufficient, but effective amount, for example from about 70 to about 90 weight percent. Thus, when 1 percent by weight of a charge enhancing additive is present, 10 percent by weight of pigment or colorant, such as magenta, and 7 percent of passivated tribofiller is contained therein, about 82 percent by weight of resin is selected.

There can also be blended with the toner compositions of the present invention external additive particles including flow aid additives, which additives are usually present on the surface thereof. Examples of these additives include colloidal silicas such as AEROSIL ®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably are present in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

Also, there can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K. K., and similar materials. The commercially available polyethylenes selected have a molecular weight $M_W$ of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Examples of colored pigments include red, blue, green, brown, magenta, cyan and/or yellow particles, as well as mixtures thereof. More specifically, with regard to the generation of color images utilizing a developer composition, colored pigments include 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. Black pigments like carbon black, such as REGAL 330®, and magnetites may, it is believed, also be passivated and selected for the toner of the present invention in embodiments. These pigments are present in various effective amounts, such as for example about 1 to about 20 weight percent.

Passivation is achieved by, for example, coating the pigment, or pigments and tribofiller particles with a polymer, especially a highly crosslinked polymer. Examples of crosslinked polymers are known and include styrene, styrene/methacrylate, styrene acrylate, and styrene/butadiene crosslinked with divinyl benzene. These polymers are added to the surface of the pigment and tribofiller particles in an amount so that the ratio of particle to coating polymer is very narrow, for example 1/1 to about ¼, on a volume basis. A known emulsion or latex type polymerization can be used to coat the particles. Passivation enables, for example, the selection of a common carrier for a number, such as three colored toners, wherein for each toner the pigment is of a different color and wherein the desired tribocharging level can be in embodiments +10 to +25 for positive toners and −10 to −25 for negative toners for each toner; the toners can possess the same, or similar imaging characteristics, especially with common carrier particles; the toners can possess similar triboelectric characteristics, for example a triboelectric value as determined by the known Faraday Cage method, or by a known charge spectrograph, within about + (plus) or − (minus) 10 tribo units, and preferably within about + or −5 tribo units for each toner.

For the formulation of developer compositions, there are mixed with the toner particles carrier components, particularly those that are capable of triboelectrically assuming an opposite polarity to that of the toner composition. Accordingly, the carrier particles of the present invention can be selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

The diameter of the carrier particles of any shape, especially spherical, is generally from about 30 microns to about 500, and preferably about 90 microns thereby permitting them to possess sufficient density and inertia to avoid adherence to the electrostatic images during the development process. The carrier component can be mixed with the toner composition in various suitable combinations, however, from about 3 to 10 parts per toner to about 100 parts to about 200 parts by weight of carrier can be selected.

The toner compositions of the present invention can be prepared by a number of known methods including extrusion melt blending the toner resin particles, passivated pigment particles or colorants, passivated tribofillers, other additives, such as charge control additives or wax, followed by mechanical attrition and classification, and thereafter adding any optional external additives. Other methods include those well known in the art such as spray drying, melt dispersion, extrusion processing, dispersion polymerization, and suspension polymerization. Also, as indicated herein the toner compositions without the charge enhancing additive can be prepared, followed by the addition of surface treated colloidal silicas with the charge additive present on the surface. Further, other methods of preparation for the toner are as illustrated herein.

The toner and developer compositions of the present invention may be selected for use in electrostatographic imaging and printing apparatuses containing therein conventional photoreceptors. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected such as those containing photogenerating layers of metal phthalocyanines, metal free phthalocyanines, squaraines, bisazos and the like, and an aryl amine charge transport layer.

The toner compositions are usually jetted and classified subsequent to preparation to enable toner particles with a preferred average diameter of from about 5 to about 25 microns, and more preferably from about 8 to about 12 microns. Also, the toner compositions of the present invention preferably possess a triboelectric charge of from about 0.1 to about 3 femtocoulombs per micron in embodiments thereof as determined by the known charge spectrograph. The toner compositions with rapid admix characteristics, such as from about 30 seconds to 2 minutes, enable, for example, the development of images in electrophotographic imaging apparatuses, which images have substantially no background deposits thereon, even at high toner dispensing rates in some instances, for example, exceeding 20 grams per minute; and further, such toner compositions can be selected for high speed electrophotographic apparatuses, that is those exceeding 70 copies per minute.

When a charge additive is utilized in admixtures with other additives, for example alkyl pyridinium halides, organic sulfates, organic sulfonates, bisulfates, distearyl dimethyl ammonium methyl sulfate, and the like, generally there is present in the mixture an effective amount of each additive, such as for example from about 30 to about 80 percent by weight of the first additive, and from about 20 to about 70 weight percent of the second charge additive in embodiments of the present invention, or from about 40 to about 60 percent by weight of the first additive of the present invention, and from about 60 to about 40 weight percent of the second charge additive. A charge additive or mixtures thereof are present in various effective amounts such as 0.1 to about 5 weight percent, and up to 15 weight percent.

The following Examples are being provided to further define various species of the present invention, it being noted that these Examples are intended to illustrate and not limit the scope of the present invention. Parts and percentages are by volume unless otherwise indicated.

EXAMPLE I (A) Three pigments were passivated by polymer encapsulation, or the coating thereof, reference U.S. Pat. No. 4,685,200, the disclosure of which is totally incorporated herein by reference. The passivated pigments were prepared by Dow Chemical wherein the polymer coating selected was a styrene-n-butyl methacrylate copolymer (58/42) crosslinked with divinylbenzene. The three pigments selected were obtained from American Hoechst Company as HOSTAPERM PINK TM (magenta), NOVAPERM YELLOW TM and PV FAST BLUE TM. Three toners with the above passivated pigments, respectively, (magenta, yellow and blue) were prepared by selecting 90 percent volume basis resin particles of uncrosslinked 58/42 weight percent of styrene/n-butyl methacrylate (refractive index of 1.483) and 10 percent by volume basis of each of the aforementioned passivated pigments. The components were melt blended in an extruder device, available as ZSK28 from Werner Pfleiderer, wherein the die was maintained at a temperature of between 130° and 145° C. and the barrel temperature ranged from about 80° to about 100° C., followed by micronization and air classification to yield toner particles in each instance of a size of 12 microns in volume average diameter. Subsequently, carrier particles were prepared by solution coating a Hoeganoes Anchor Steel core with a particle diameter range of from about 75 to about 150 microns, available from Hoeganoes Company, with 0.4 parts by weight of a coating comprising 20 parts by weight of VULCAN® carbon black, available from Cabot Corporation, homogeneously dispersed in 80 parts by weight of a chlorotrifluoroethylene-vinyl chloride copolymer, commercially available as OXY 461® from Occidental Petroleum Company, which coating was solution coated from a methyl ethyl ketone solvent. Three developers (magenta, yellow, and blue) were then prepared by blending 97.5 parts by weight of the coated carrier particles with 2.5 parts by weight of each of the above prepared three toners in a Lodige Blender for about 10 minutes resulting in developers with toners exhibiting triboelectric charges of +18 microcoulombs per gram for each of the three toners as determined in the known Faraday Cage apparatus and wherein the carrier conductivity was $6.6\times10^{-10}$ (ohm-cm)$^{-1}$.

(B) A tribofiller was prepared by selecting small, 0.4 micron, polymethyl methacrylate (refractive index 1.49) available as TP-4 TM from Nippon Paint Company Japan, and thereafter, passivating the polymethyl methacrylate by repeating the above process wherein a crosslinked styrene-n-butyl methacrylate (58/42) was selected. A toner was then prepared by blending 90 percent volume basis resin particles of noncrosslinked, 58/42 weight percent, styrene/n-butyl methacrylate (refractive index of 1.483) and 10 percent volume basis of the passivated polymethyl methacrylate polymer particles. The components were then melt blended by the above procedure to enable toner compositions. A developer was then prepared with the same carrier and method of above Example (A) resulting in a toner containing only tribofiller, and exhibiting a triboelectric charge of +18 microcoulombs per gram as determined in the known Faraday Cage apparatus and wherein the carrier conductivity was $6.6\times10^{-10}$ (ohm-cm)$^{-1}$.

Also, the aforementioned toners exhibited stable triboelectric charging characteristics after one hour on a roll mill.

(C) A magenta toner was prepared with 94 percent volume basis resin particles of noncrosslinked, 58/42 weight percent, styrene/n-butyl methacrylate (refractive index of 1.483) and 6 percent volume basis of the passivated magenta pigment of the above Example (A). The toner was prepared in accordance with the method of Example (A). A magenta developer was then prepared using the same carrier and method of Example (A). The resulting toner exhibited a triboelectric charge of +10 microcoulombs per gram as determined in the known Faraday Cage apparatus.

(D) A magenta toner was prepared with 90 percent volume basis resin particles of noncrosslinked, 58/42 weight percent, styrene/n-butyl methacrylate (refractive index of 1.483) and 6 percent volume basis of the passivated magenta pigment of Example (A) plus 4 percent of the tribofiller of Example (B) for a total volume of passivated pigments plus tribofiller equal to 10 percent. A toner was prepared in accordance with the above method of Example (A). A magenta developer was then prepared using the same carrier and method of Example (A). The resulting toner exhibited a triboelectric charge of +18 microcoulombs per gram as determined in the known Faraday Cage apparatus.

(E) A yellow toner was prepared with 92 percent volume basis resin particles of noncrosslinked, 58/42 weight percent, styrene/n-butyl methacrylate (refractive index of 1.483) and 8 percent volume basis of the passivated yellow pigment of Example (A). A toner was prepared in accordance with the method of Example (A). A yellow developer was then prepared using the same carrier and method of Example (A). The resulting toner exhibited a triboelectric charge of +14 microcoulombs per gram as determined in the known Faraday Cage apparatus.

(F) A yellow toner was prepared with 90 percent volume basis resin particles of noncrosslinked, 58/42 weight percent, styrene/n-butyl methacrylate (refractive index of 1.483) and 8 percent volume basis of the passivated yellow pigment of Example (A) plus 2 percent of the tribofiller of Example (B) for a total volume of passivated pigment plus tribofiller equal to 10 percent. A toner was then prepared in accordance with the above method of Example (A). A yellow developer was then prepared using the same carrier and method of Example (A). The resulting toner exhibited a triboelectric charge of +18 microcoulombs per gram as determined in the known Faraday Cage apparatus.

(G) A blue toner was prepared with 96 percent volume basis resin particles of noncrosslinked, 58/42 weight percent, styrene/n-butyl methacrylate (refractive index of 1.483) and 4 percent volume basis of the passivated blue pigment of Example (A). A toner was then prepared in accordance with the method of Example (A). A blue developer was then prepared using the same carrier and method of above mentioned Example (A). The resulting toner exhibited a triboelectric charge of +6 microcoulombs per gram as determined in the known Faraday Cage apparatus.

(H) A blue toner was prepared with 90 percent volume basis resin particles of noncrosslinked, 58/42 weight percent, styrene/n-butyl methacrylate (refractive index of 1.483) and 4 percent volume basis of the passivated blue pigment of Example (A) plus 6 percent of the tribofiller of Example (B) for a total volume of passivated pigments plus tribofiller equal to 10 percent. A toner was then prepared in accordance with the above method of Example (A). A blue developer was then prepared using the same carrier and method of Example (A). The resulting toner exhibited a triboelectric charge of +18 microcoulombs per gram as determined in the known Faraday Cage apparatus.

Three colored toners (D, F, H) containing various volume loadings of the three (magenta, yellow and blue) passivated pigments were thus prepared with the resulting toner tribo for each to +18 microcoulombs per gram as determined in the known Faraday Cage apparatus.

EXAMPLE II (I) Three pigments were passivated by polymer encapsulation by essentially repeating the process of Example I. One pigment was HOSTAPERM PINK E TM (magenta) available from Hoechst Company of Germany and the other two pigments were PALIOTOL YELLOW TM and NEOPEN BLUE 802 TM available from BASF Company, Germany. The pigments were treated by encapsulation with a crosslinked polymer of melamine formaldehyde. Three toners were prepared with 88 percent by volume of suspension polymerized styrene butadiene copolymer resin particles (87/13) (refractive index 1.52), reference U.S. Pat. No. 4,558,108, the disclosure of which is totally incorporated herein by reference, and 12 volume percent of the passivated pigment. The toner components were extruded in an extrusion device, a melting temperature maximum of 410° F., available as ZSK28 from Werner Pfleiderer at a rate of 15 pounds per hour. The strands of melt mixed product exiting from the extruder were cooled by immersing them in a water bath maintained at room temperature, about 25° C. Subsequent to air drying, the resulting toners were subjected to grinding in a Sturtevant micronizer enabling toner particles with a volume median diameter of from 8 to 11 microns as measured by a Coulter Counter. Thereafter, the aforementioned toner particles were classified in a Donaldson Model B classifier for the purpose of removing fine particles, that is those with a volume median diameter of less than 4. Subsequently, the above formulated toners, 3 parts by weight, were mixed with 97 parts by weight of a carrier containing a steel core with a coating of a polymer mixture thereof, 0.70 percent by weight, which polymer mixture contained 40 parts by weight of polyvinylidene fluoride, and 60 parts by weight of polymethyl methacrylate, and wherein mixing was accomplished in a paint shaker for 10 minutes. There resulted on the toner compositions, as determined in the known Faraday Cage apparatus, positive toner triboelectric charges of 36 microcoulombs per gram for each of the three toners.

(J) A tribofiller was prepared with small, 0.6 micron, Orthoclase ($KALSi_3O_8$) glass particles (refractive index 1.51) which was passivated by the same method of Example (I). A toner was prepared with 88 percent by volume of suspension polymerized styrene butadiene copolymer resin particles (87/13) (refractive index 1.52), 12 volume percent of passivated tribofiller, by repeating the above extrusion process. A developer was prepared with the same carrier and method of above Example (I). There resulted on the toner composition, as determined in the known Faraday Cage apparatus, a positive toner triboelectric charge of 36 microcoulombs per gram.

(K) A magenta toner was prepared with 90 percent volume basis resin particles of suspension polymerized styrene butadiene copolymer resin particles (87/13) (refractive index 1.52), and 10 percent volume basis of the passivated magenta pigment of Example (I). A toner was then prepared in accordance with the method of Example (I). A magenta developer was then prepared using the same carrier and method of Example (I). The resulting toner exhibited a triboelectric charge of +30 microcoulombs per gram as determined in the known Faraday Cage apparatus.

(L) A magenta toner was prepared with 88 percent volume basis resin particles of suspension polymerized styrene butadiene copolymer resin particles (87/13) (refractive index 1.52), and 10 percent volume basis of the above.passivated magenta pigment plus 2 percent of the passivated tribofiller of (J). A toner was prepared in accordance with the method of Example (I). A magenta developer was then prepared using the same carrier and method of the above Example. The resulting toner exhibited a triboelectric charge of +36 microcoulombs per gram as determined in the known Faraday Cage apparatus.

(M) A blue toner was prepared with 92 percent volume basis resin particles of suspension polymerized styrene butadiene copolymer resin particles (87/13) (refractive index 1.52), and 8 percent volume basis of the passivated blue pigment of Example (I). A toner was then made in accordance with the above method of Example (I). A blue developer was then prepared using the same carrier and method of Example (I). The resulting toner exhibited a triboelectric charge of +24 microcoulombs per gram as determined in the known Faraday Cage apparatus.

(N) A blue toner was prepared with 88 percent volume basis resin particles of suspension polymerized styrene butadiene copolymer resin particles (87/13) (refractive index 1.52), and 8 percent volume basis of the passivated blue pigment of above Example (I) plus 4 percent volume basis of the passivated tribofiller (J). A toner was then made in accordance with the above method of Example (I). A blue developer was then prepared using the same carrier and method of above Example (I). The resulting toner exhibited a triboelectric charge of +36 microcoulombs per gram as determined in the known Faraday Cage apparatus.

Therefore, three colored toners (yellow from (I), magenta (L) and blue (N) containing various volume loadings of three (magenta, yellow and blue) passivated pigments were made with the resulting toner tribo for each being +36 microcoulombs per gram as determined in the known Faraday Cage apparatus.

Other modifications of the present invention may occur to those skilled in the art subsequent to a review of the present application, and these modifications, including equivalents thereof, are intended to be included within the scope of the present invention.

What is claimed is:

1. A toner composition consisting essentially of resin particles passivated pigment particles encapsulated within a polymeric coating, and a passivated tribofiller component coated with a polymeric coating, and wherein the tribofiller component possesses the same, or substantially the same index of refraction as the resin particles in the visible region of the spectrum; and wherein said tribofiller is selected from the group consisting of orthoclase, albite, fused silica, a metal halide, magnesium oxide, soda lime, and glass.

2. A toner composition in accordance with claim 1 wherein the tribofiller is present in an amount of from about 0.2 to about 15 weight percent of the toner on a volume basis.

3. A toner in accordance with claim 1 wherein the tribofiller is passivated by encapsulation with a polymer coating and is a finely divided substance with an average volume diameter of about 0.05 to about 2 microns, and the polymer is a styrene, a polyester, a styrene acrylate, a styrene methacrylate, a styrene butadiene, a methyl methacrylate, or mixtures thereof.

4. A toner in accordance with claim 1 wherein the passivated pigment particles are comprised of carbon black, magenta, cyan, yellow, red, blue, green, brown, or mixtures thereof.

5. A toner in accordance with claim 4 wherein the polymer coating is a crosslinked polymer of styrene n-butyl methacrylate, melamine formaldehyde, polyester, styrene butadiene, styrene acrylate, styrene methacrylate, or mixtures thereof.

6. A toner composition in accordance with claim 1 wherein the resin particles are comprised of styrene polymers, polyesters, or mixtures thereof.

7. A toner composition in accordance with claim 1 wherein the tribofiller has an index of refraction of from about 1.4 to about 1.6 and the resin particles have an index of refraction of from about 1.4 to about 1.6.

8. A toner composition in accordance with claim 1 containing a wax component with a weight average molecular weight of from about 600 to about 7,000.

9. A toner composition in accordance with claim 8 wherein the waxy component is selected from the group consisting of polyethylene and polypropylene.

10. A toner composition in accordance with claim 1 wherein the pigment particles are cyan, magenta, yellow, red, blue, green, brown, white, or mixtures thereof.

11. A developer composition comprised of the toner composition of claim 1 and carrier particles.

12. A developer composition comprised of the toner composition of claim 6 and carrier particles.

13. A developer composition in accordance with claim 11 wherein the carrier particles are comprised of ferrites, steel, or an iron powder.

14. A developer composition in accordance with claim 12 wherein the carrier particles are comprised of a core with a polymer coating thereover.

15. A developer composition in accordance with claim 14 wherein the coating is comprised of a methyl terpolymer, a polyvinylidine fluoride, a polymethyl methacrylate, or a mixture of polymers not in close proximity in the triboelectric series.

16. A process for obtaining passivated toners by adding to toner resin particles colored passivated pigment particles encapsulated within a polymeric coating, and a passivated tribofiller component coated with a polymeric coating, and wherein the tribofiller component possesses the same, or substantially the same index of refraction as the resin particles in the visible portion of the spectrum; and wherein said tribofiller is selected from the group consisting of orthoclase, albite, fused silica, a metal halide, magnesium oxide, soda lime, and glass.

17. A process in accordance with claim 16 wherein from about 1 to about 10 weight percent of toner pigment is selected, from about 15 to about 1 weight percent of tribofiller is selected, and from about 70 to about 98 percent by weight of polymeric coating is selected.

18. A process in accordance with claim 16 wherein the polymer coating is a styrene, a polyester, a styrene acrylate, a styrene methacrylate, a styrene butadiene, a methyl methacrylate, or mixtures thereof.

19. A process in accordance with claim 16 wherein the polymer coating for the pigment particles is a styrene, a polyester, a styrene acrylate, a styrene methacrylate, a styrene butadiene, a methyl methacrylate, or mixtures thereof.

20. A process in accordance with claim 16 wherein the pigment particles are selected from the group consisting of carbon black, cyan, magenta, yellow, green, blue, brown, or mixtures thereof.

21. A toner composition in accordance with claim 1 wherein there is obtained a passivated toner achieved by encapsulating said pigment and coating said tribofiller component.

* * * * *